US005786567A

United States Patent [19]

Wang

[11] Patent Number: 5,786,567

[45] Date of Patent: Jul. 28, 1998

[54] OVEN

[76] Inventor: Ching-Hsiang Wang, No. 9, Lane 110, Section 4 Si-Men Road, Tainan 704, Taiwan

[21] Appl. No.: 791,355

[22] Filed: Jan. 30, 1997

[51] Int. Cl.[6] ..... A21B 1/26; F27O 7/04; F24C 15/32

[52] U.S. Cl. ..... 219/400; 126/21 A

[58] Field of Search ..... 219/400, 401; 126/21 A; 99/474, 475, 476; 34/225

[56] References Cited

U.S. PATENT DOCUMENTS

| | | | |
|---|---|---|---|
| 3,984,578 | 10/1976 | Rohrl et al. | 126/21 A |
| 4,413,171 | 11/1983 | Klammers | 219/400 |
| 4,415,799 | 11/1983 | Tanaka et al. | 219/400 |
| 4,561,348 | 12/1985 | Halters et al. | 219/400 |
| 4,780,596 | 10/1988 | Matsushima et al. | 219/400 |
| 5,468,935 | 11/1995 | Wang | 219/400 |
| 5,601,070 | 2/1997 | Hotard et al. | 126/21 A |

*Primary Examiner*—Philip H. Leung
*Assistant Examiner*—J. Pelham

[57] ABSTRACT

An oven includes a rear wall plate, a hot current device combined with the rear wall plate. The hot current device consists of a fan disc, a separating plate, two fans, and a rotating power unit having a motor and a motor frame. The two fans are rotated by the motor to blow hot air in a chamber of the oven to be sucked in a space between the fan disc and the separating plate and then exhausted out of the space into the chamber back through exhausting holes of the fan disc, and circulating around in the chamber because of the exhausting holes arranged in a radiating condition.

2 Claims, 5 Drawing Sheets

OVEN

BACKGROUND OF THE INVENTION

This invention relates to an oven, particularly to an oven provided with a hot current device combined with a rear wall plate, by which hot air current may be blown and circulated evenly in a chamber of the oven to broil a broiler put on a disc plate wholly and evenly.

A known conventional oven 1 shown in FIG. 1 includes electric heating wire deposited under a broiling frame, and heat produced by the heating wire rises up to the broiling frame for broiling an object put on it.

However, the heat produced in the oven is not even, different in an upper portion and in the lower portion so that the object to be broiled may be broiled not evenly. Consequently broiling function is bad, with a lower part of an object well broiled but an upper part not yet well broiled. If the object is continued to be broiled to let the upper part well broiled, the lower part may be broiled too much, becoming scorched. Even if the object should be turned over sometimes, the surface the object may be quickly broiled but the deep portion may not yet be broiled, as heat transmission of the object is not quick enough to reach the deep portion, so chances are that the surface is excessively broiled but the deep portion is still half row. In addition, this conventional oven takes long time in broiling and inconvenient to handle.

SUMMARY OF THE INVENTION

The main purpose of the invention is to offer an oven, which blows hot air current into a chamber for broiling, and lets it circulate around in the chamber evenly to let every part of an object receive hot air current so as to be broiled evenly.

A main feature of the invention is a rear wall plate having a recess for receiving a hot current device therein, which supplies hot air current to a chamber for broiling. The hot air current device consists of a separating plate, two fans, a fan disc, and rotating power unit. The separating plate has a recess with a center shaft hole for the fan disc to fit therein, and the two fans are respectively located in front of and behind the separating plate and having a center shaft hole. The fan disc is screwed in the recess of the separating plate, covering a front fan, having sucking holes and exhausting holes. The rotating power unit includes a motor and a motor frame. The motor frame is combined with the rear surface of the separating plate, covering a rear fan. The motor has a transmitting shaft from the motor frame, the two fans for rotating the two fans to blow air current in the chamber and be sucked into the space between the fan disc and the recess of the separating plate, and then exhausted into the chamber back through the exhausting holes of the fan disc to become circulating hot air current in the chamber because of a radiating condition of the exhausting holes.

BRIEF DESCRIPTION OF DRAWINGS

This invention will be better understood by referring to the accompanying drawings, wherein.

DESCRIPTION OF THE PREFERRED EMBODIMENT

Figure 1:
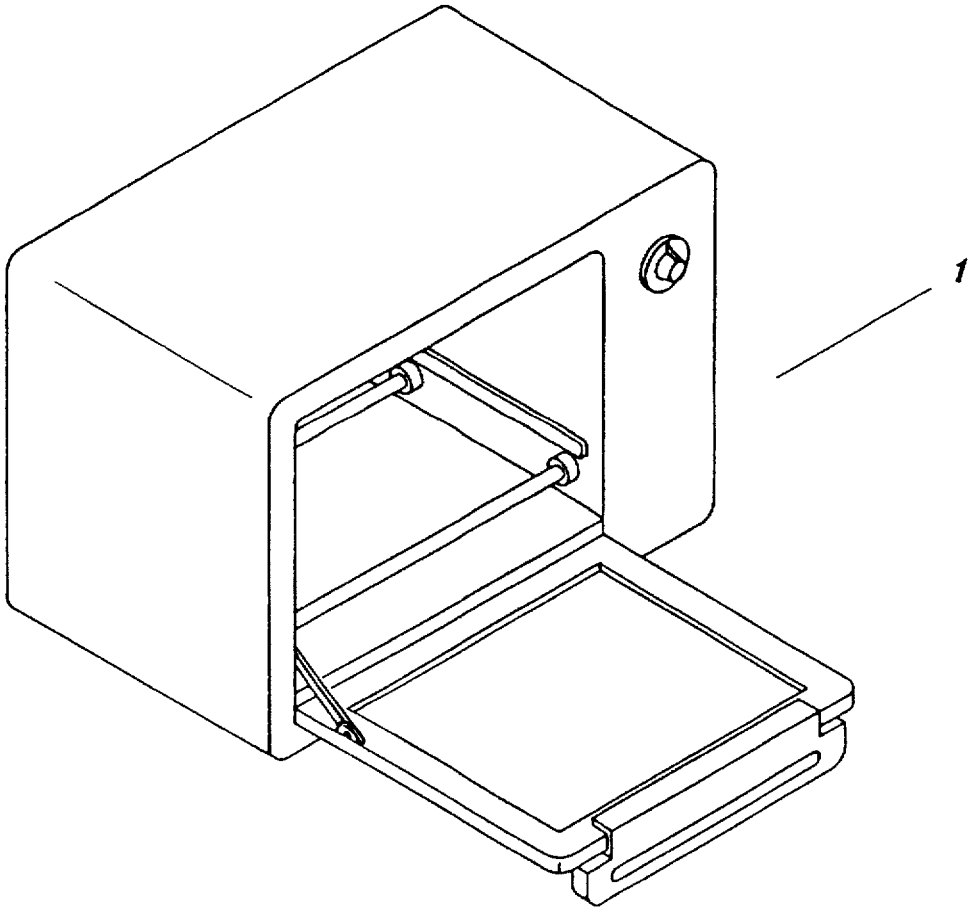
FIG. 1 (PRIOR ART)
FIG. 1 is a perspective view of a known conventional oven.
Figure 2:
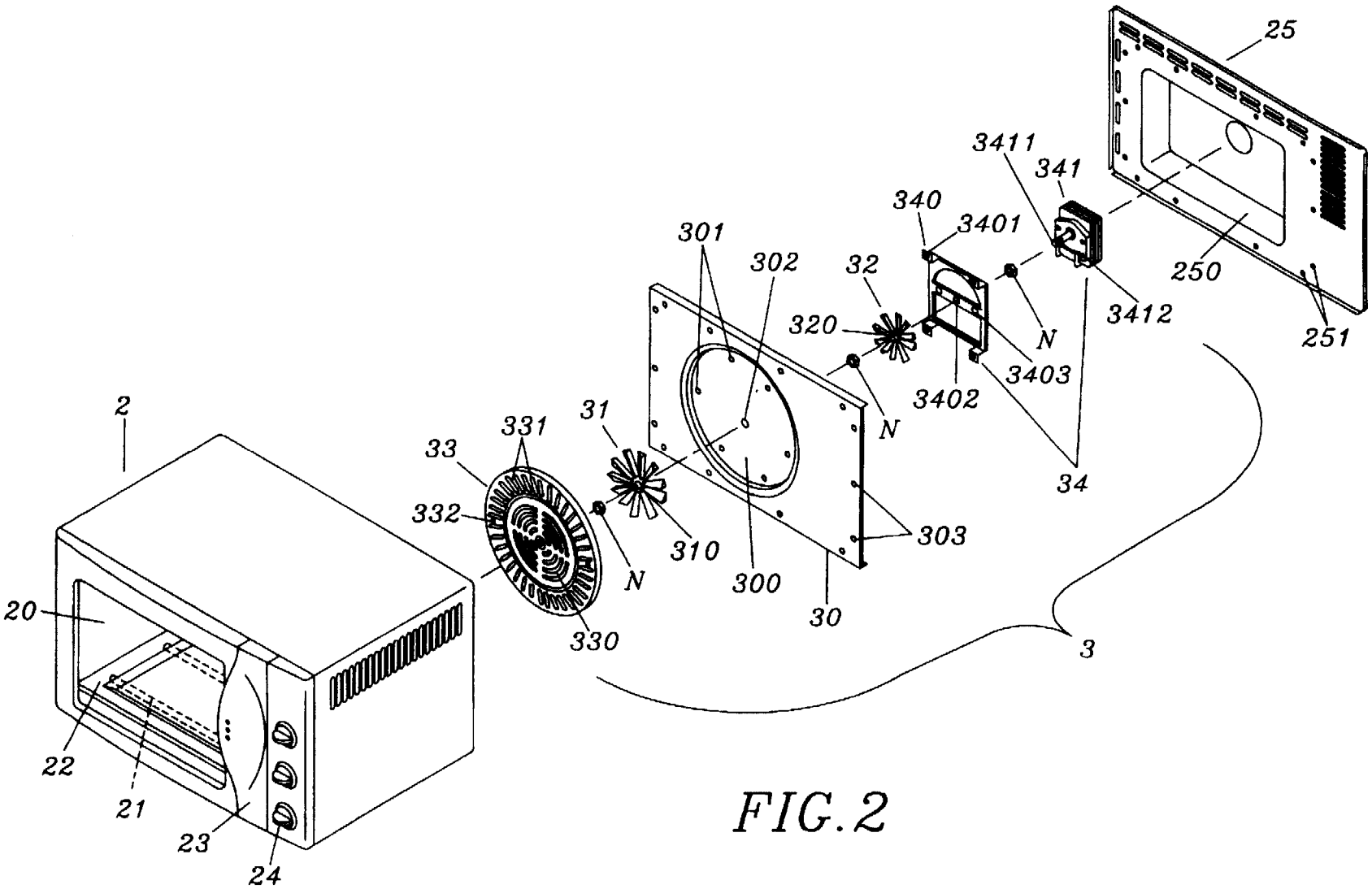
FIG. 2 is an exploded perspective view of a preferred embodiment of a oven in the present invention.

A preferred embodiment of an oven 2 in the present invention, as shown in FIG. 2, includes a chamber 20, an electric heating tube 21 extending in an upper portion and a lower portion of the chamber 20, a disc plate 22 on the heating tube 21 in the lower portion of the chamber 20, a curved mirror front door 23 at a front side, control switches 24 fixed on the front side beside the door 23, a rear wall plate 25 located at a rear side, and a hot current device 3 as main components combined together.

The rear wall plate 25 has a recess 250 sinking back in a center portion, and plural threaded holes 251 spaced around near a periphery.

The hot current device 3 is combined with the rear wall plate 25 with screws engaging the threaded holes 251, consisting of a separating plate 30, two fans 31, 32, a fan disc 33, and a rotating power unit 34. The separating plate 30 is shaped as a plate, having a disc-shaped recess 300 sinking back, several combining holes 301 spaced around near the periphery of the disc-shaped recess 300, a shaft hole 302 in the center of the disc-shaped recess 300, and screw holes 303 spaced around the periphery at corresponding locations to the threaded holes 251 of the rear wall plate 25. A front fan 31 and a rear fan 32 are respectively located in front of the recess 300 and behind the recess 300, respectively having a center shaft hole 310, 320. The fan disc 33 is combined with the separating plate 30 in the recess 300 covering the fan 31, having curved sucking holes 330 spreading around a center portion and divided into plural groups, plural exhausting elongated holes 331 spaced around near a peripheral edge and arranged in a radiating condition, and several threaded holes 332 at corresponding locations to the combining holes 301 of the separating plate 30.

The rotating power unit 34 is combined in the recess 250 of the rear wall plate 25, consisting of a motor frame 340 and a motor 341. The motor frame 340 is screwed with the rear surface of the recess 300 of the separating 30, having two threaded holes 3401 facing the combining holes 301 of the separating plate 30, a center shaft hole 3402 in line with the shaft hole 302 of the recess 300 and with the center shaft holes 310, 320 of the fans 31, 32, two screw holes 3403 at two sides of the center shaft hole 302. The motor 341 has a transmitting shaft 3411 extending to protrude through the shaft hole 3402 of the motor frame 340, the center shaft hole 320 of the second fan 32, the center shaft hole 302 of the separating plate 30 and the center shaft hole 310 of the front fan 31. The motor 341 further has two threaded holes 3412 for screws N to fix the motor 341 with the motor frame 340.

Figure 3:
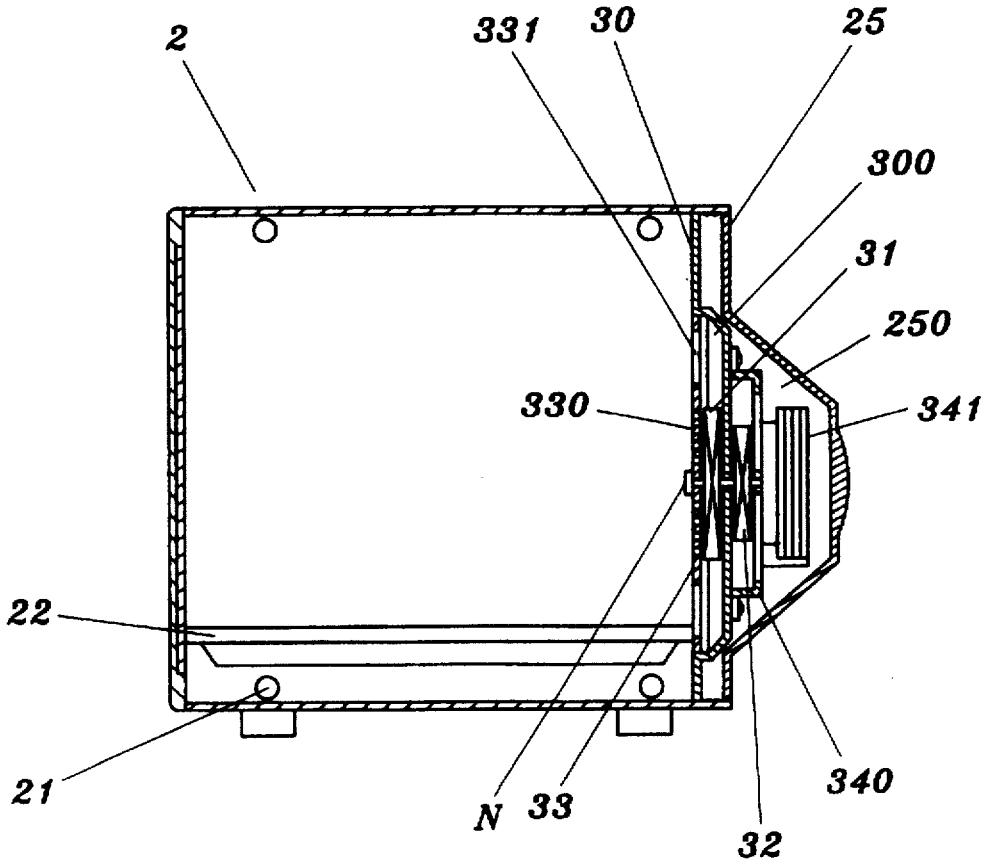
FIG. 3 is a side cross-sectional view of the preferred embodiment of an oven in the present invention.

In assembling, referring to FIGS. 2 and 3, firstly the transmitting shaft 3411 of the motor 341 is made to protrude through the center shaft hole 3402 of the motor frame 340, and then the screw holes 3403 and the threaded holes 3412 are aligned to each other and then screwed together. Next, the shaft 3411 of the motor 341 is pushed to protrude through the center shaft holes 320 of the rear fan 32, the shaft hole 302 of the separating plate 30 and the center shaft hole 310 of the front fan 31. Then the motor frame 340 is combined with the rear surface of the separating plate 30 with screws engaging the threaded holes 3401 and combining holes 301, and a nut N screws with an outer end of the shaft 3411 so as to combine the motor 341 with the related components, 340, 32, 30 and 31. Then the fan disc 33 is covered on the front fan 31 and combined with the separating plate 30, with screws engaging the threaded holes 332, and the combining holes 301 of the recess 300 of the separating plate 30. Lastly, the assembled hot current device 3 is combined with the rear wall plate 25, with the combining holes 303 of the separating plate 30 aligned with the threaded holes 251 of the rear wall plate 25 and then screwed together, finishing assemblage of the oven.

Figure 4:
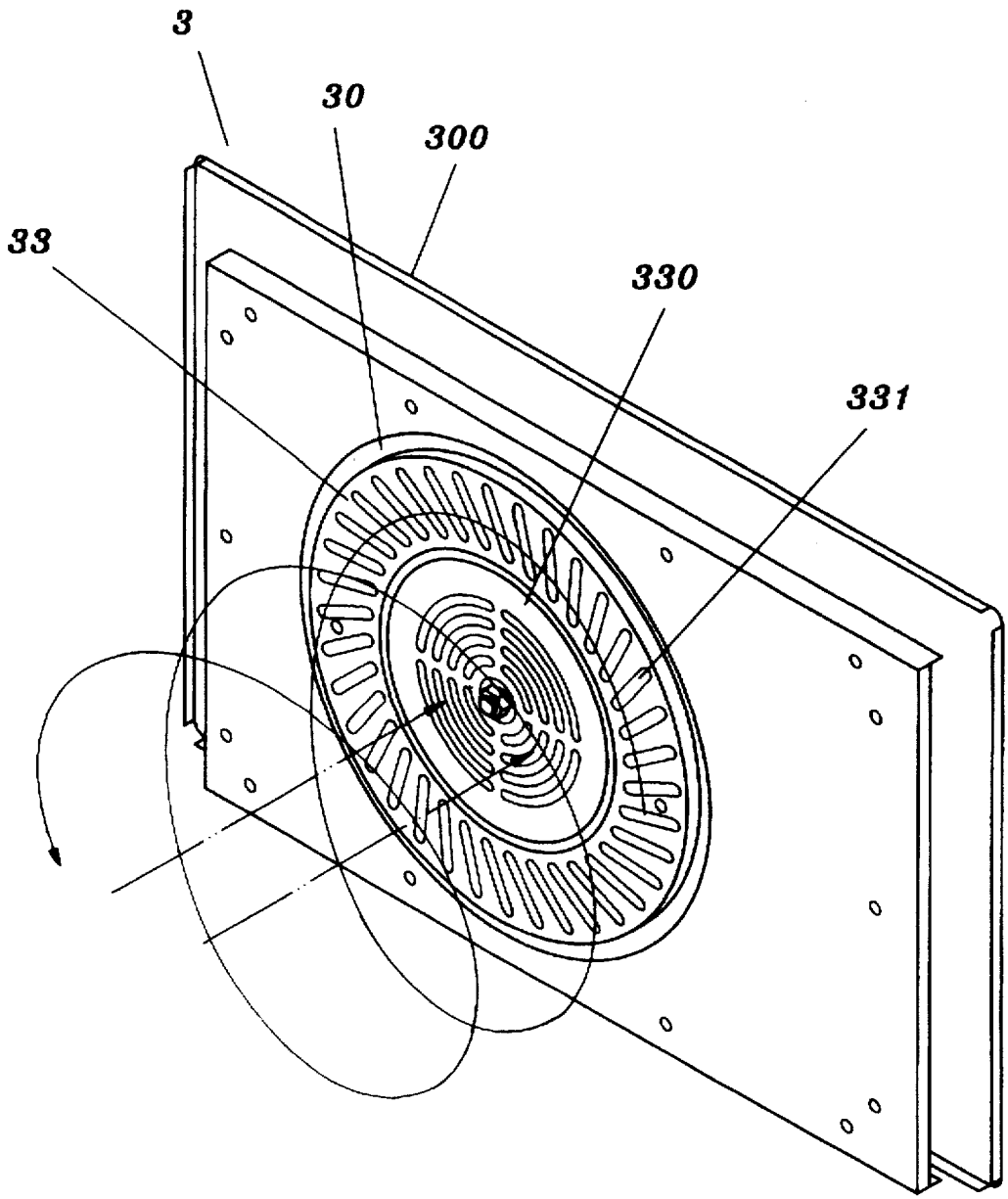
FIG. 4 is a perspective view of a hot current device of the preferred embodiment of an oven in the present invention, showing the direction of air current produced by the hot current device; and, FIG. 5 is a cross-sectional view of the preferred embodiment of an oven in the present invention, showing a chick being broiled therein.
Figure 5:
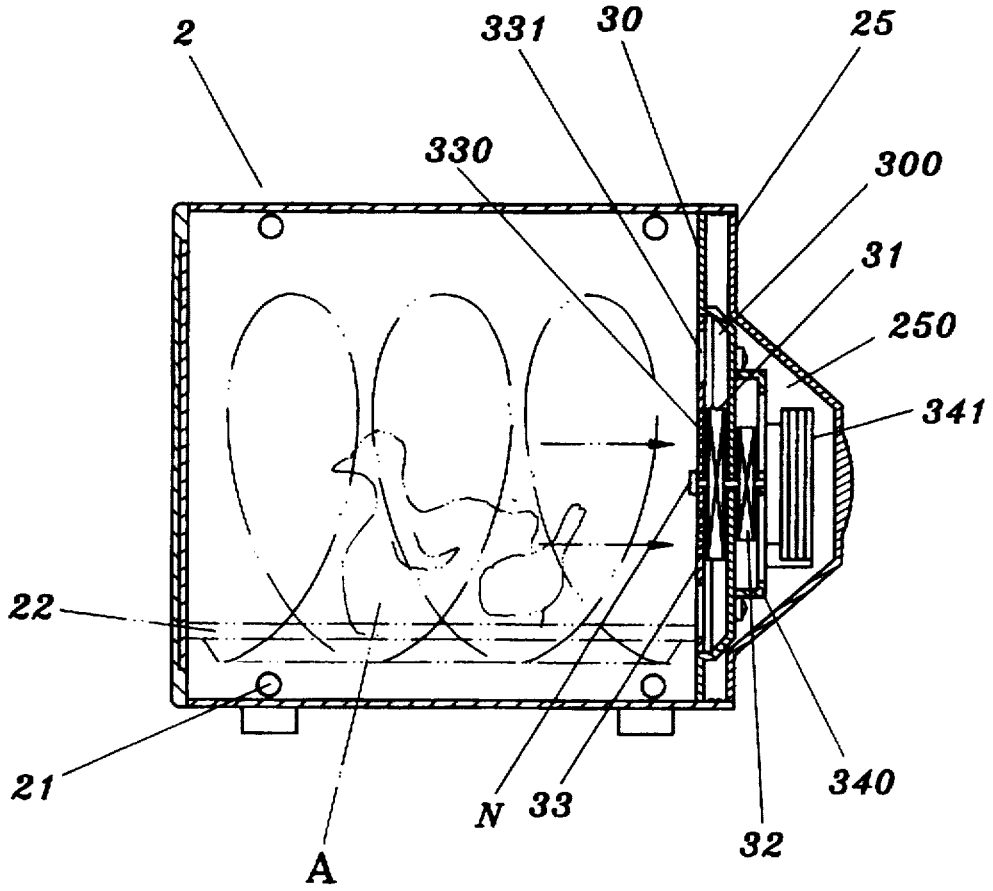

In using this oven, referring to FIGS. 3, 4 and 5, a broiler A is put on the disc plate 22 in the chamber 20 of the oven 2. Then the heating tube 21 is electrified, heating the air in the chamber 20, and then hot air is then sucked through the sucking holes 330 into the space between the fan disc 33 and the recess 300 of the separating plate 30 by the front fan 31 rotated by the transmitting shaft 3411 of the motor 341. Then sucked-in hot air is dispersed by the fans 31, and exhausted through the exhausting holes 331 out into the chamber 20 back by means of centrifugal force. The hot air current is blown to flow in 360 degrees according to the radiating condition of the exhausting holes 331 so that hot current may flow evenly in the chamber 20 as if the broiler A were incessantly rotated around on a rotating broiling frame, getting every part of it broiled well with good taste and brown color.

While the preferred embodiment of the invention has been described above, it will be recognized and understood that various modifications may be made therein and the appended claims are intended to cover all such modifications which may fall within the spirit and scope of the invention.

What is claimed is:

1. An oven having an openable and closeable chamber for placing a broiler on a disc plate therein for broiling, an electric heating tube provided to extend in an upper portion and a lower portion of said chamber, said disc plate located on the lower portion of said electric heating tube;

a rear wall plate having a rearward recess in a center portion, and a hot current device combined with said rear wall plate, and comprising:

a separating plate having a disc-shaped rearward recess and a shaft hole in a center of said recess;

a front fan located in said disc-shaped recess in front of said separating plate and a rear fan located behind said separating plate, both said fans having a shaft hole in a center;

a substantially planar fan disc extending across said recess of said separating plate, covering said front fan, said fan disc having a plurality sucking holes arranged in a first circular array in a center portion and a plurality of elongated exhausting holes spaced apart and arranged in a second circular array adjacent to a periphery, each of said plurality of sucking holes in said fan disc having an elongated arcuate configuration; and, a rotating power unit consisting of a motor frame and a motor, said motor having a transmitting shaft extending forward to protrude through said motor frame, said shaft hole of said separating plate and said shaft holes of said two fans for rotating said two fans; whereby said hot current device draws hot air in said chamber through said sucking holes of said fan disc into a space between said fan disc and said recess of said separating plate, the hot air drawn into said space being exhausted out of said space through said exhausting holes of said fan disc into said chamber to create a circulating current in said chamber so that a broiler put on said disc plate in said chamber may be broiled evenly and balanced.

2. The oven as claimed in claim 1, wherein said rear wall plate and said separating plate are attached together.

* * * * *